US005243972A

United States Patent [19]

Huang

[11] Patent Number: 5,243,972

[45] Date of Patent: Sep. 14, 1993

[54] SMOKE-PROOF MASK

[76] Inventor: Ho-Tsun Huang, No. 88, Pi-Hsiu Road, Chiao Tou Hsiang, Kaohsiung Hsien, Taiwan

[21] Appl. No.: 986,565

[22] Filed: Dec. 7, 1992

[51] Int. Cl.[5] ..... A62B 18/02; A62B 7/00; A62B 9/00; A62B 18/10

[52] U.S. Cl. ..... 128/205.25; 128/205.22; 128/207.12

[58] Field of Search ..... 128/205.25, 206.24, 128/206.28, 207.12, 201.24, 201.28, 203.29, 206.12, 206.15, 205.22

[56] References Cited

U.S. PATENT DOCUMENTS

| | | | |
|---|---|---|---|
| 787,167 | 4/1905 | Gates | 128/206.24 |
| 902,961 | 11/1908 | Goodnow | 128/207.12 |
| 2,359,008 | 9/1944 | Smith | 128/207.12 |
| 2,625,155 | 1/1953 | Engelder | 128/206.24 |
| 2,665,686 | 1/1954 | Wood et al. | 128/206.24 |
| 5,109,839 | 5/1992 | Blasdell et al. | 128/205.25 |

*Primary Examiner*—Edgar S. Burr
*Assistant Examiner*—Kimberly L. Asher
*Attorney, Agent, or Firm*—Morton J. Rosenberg; David I. Klein

[57] ABSTRACT

A smoke-proof mask having a body with an upper chamber and a lower chamber, an exhaling valve fixed on the body for exhaled air to flow out, and an oxygen chamber provided in a lower portion of the body to receive and store oxygen coming from a small oxygen tank, the oxygen in the chamber being inhaled by a mouth of a wearer to pass through small holes in the chamber to move into the lower chamber in the body and through the mouth into his lung, and exhaled air coming out of the nose of the wearer being exhausted from the upper chamber through the exhaling valve into open air.

1 Claim, 3 Drawing Sheets

SMOKE-PROOF MASK

BACKGROUND OF THE INVENTION

Dense smoke produced in a fire is a dangerous threat to persons trapped in a fire and fire fighters, so smoke-proof masks are quite important to escape from a fire or to fight for extinguishing it.

Conventional smoke-proof masks to be used in a fire are generally structured rather complicated to have a high cost.

SUMMARY OF THE INVENTION

This invention has been devised to offer a kind of smoke-proof mask having a rather simple structure and an easy convenience for use.

The smoke-proof mask in the present invention, has been planned to have features listed as follows.

1. Soft linings are provided to tightly contact a face surface, preventing smoke or open air from flowing into the mask.

2. It has an upper chamber and a lower chamber in a mask body, the lower chamber is for a mouth of a wearer to inhale oxygen, and the upper chamber is for a wearer's nose to exhale air, preventing the oxygen in the lower chamber from mixing with exhaled air in the upper chamber.

3. It has an exhaling valve for exhaled air of a wearer to easily escape out into open air and to prevent smoke from coming into the mask.

4. It is very useful for a person to escape a fire with safety if used along with a protective eye glasses.

BRIEF DESCRIPTION OF DRAWINGS

The invention will be better understood by reference to the accompanying drawings, wherein.

DETAILED DESCRIPTION OF THE INVENTION

Figure 1:
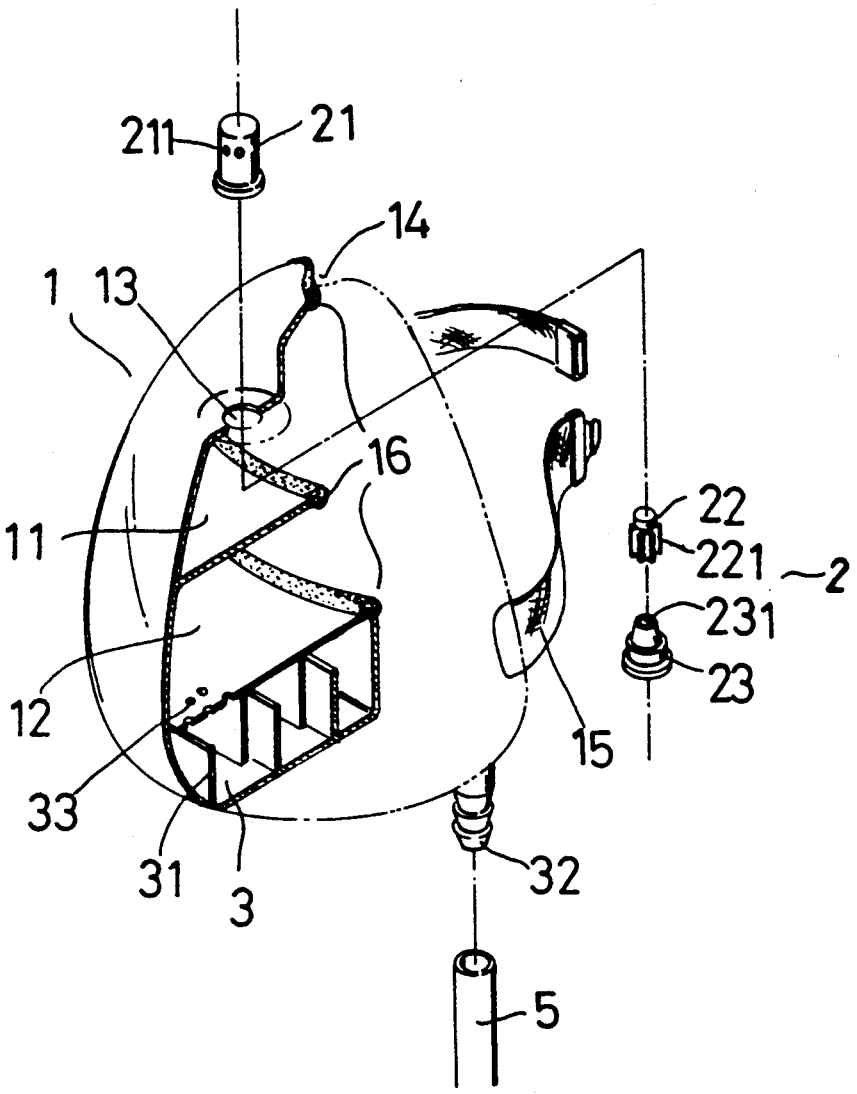
FIG. 1 is an exploded perspective view of a smoke-proof mask in the present invention.
Figure 2:
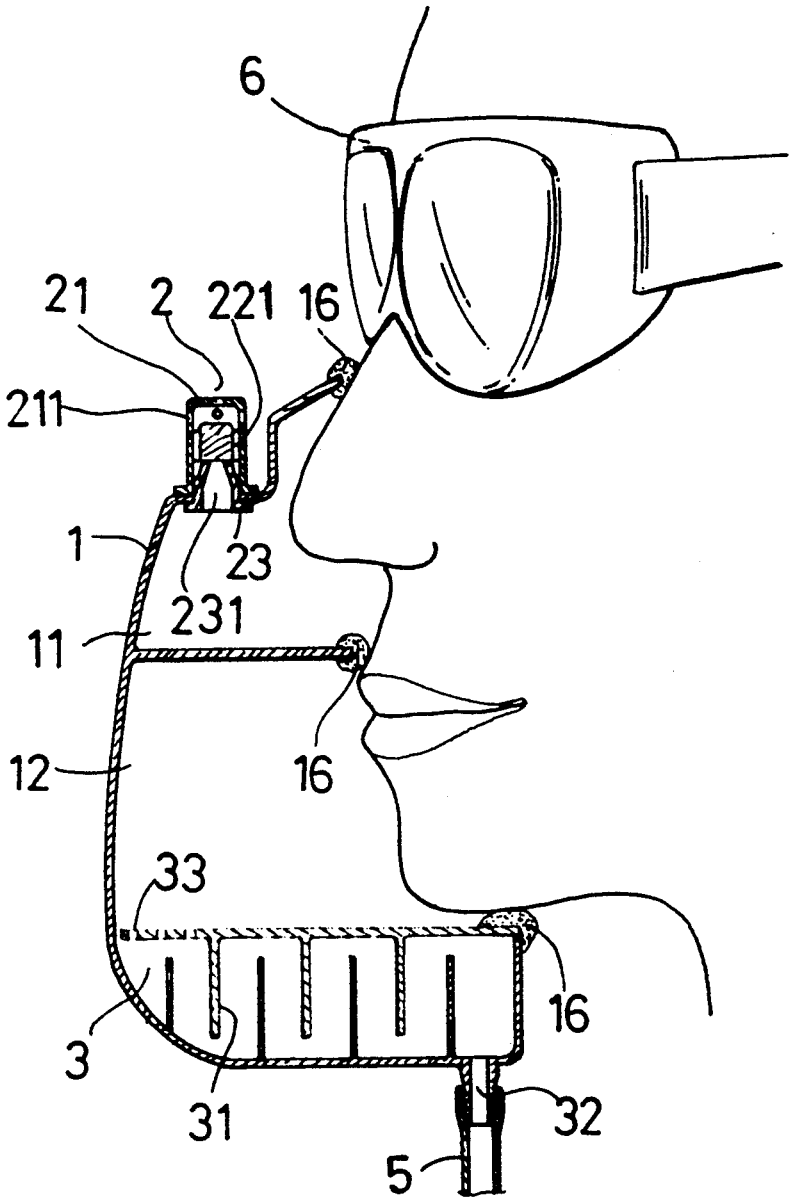
FIG. 2 is a cross-sectional view of the smoke-proof mask applied on a person's face in the present invention; and, FIG. 3 is a perspective view of the smoke-proof mask completely applied on a person in the present invention.

A smoke-proof mask in the present invention, as shown in FIG. 1, comprises a body 1, an exhaling valve 2 and an oxygen chamber 3.

The body 1 has an upper chamber 11, a lower chamber 12, a hole in an upper portion of the upper chamber 11 for fixing the exhaling valve 2 therein, a groove 14 at an upper end, and an adjustable band 15 to be bound around a person's neck, and a soft lining 16 along a circumferential edge of an rear side to tightly contact a face surface.

The exhaling valve 2 consists of an upper cap 21, a sliding member 22, and a base 3 combined together. The upper cap 21 is shaped cylindrical, bored with a plurality of outlet holes 211, and the sliding member 22 fits in the upper cap 21 to slide up and down therein, having a plurality of vertical ridges 221 to contact the inner wall of the upper cap 21 and thus a plurality of passageways 222 are formed between the upper cap 21 and the sliding member 22. The base 23 passes through and is kept in the hole in the body 1 to insert in the upper cap 21 to sustain the sliding member 22, having a central through hole 231 for gas to flow through.

The oxygen chamber 3 is provided in a lower portion of the body 1 under the lower chamber 12, having a plurality of separating vertical plates spaced apart, an inlet tap 32 extending out of the chamber 3 and some breathing holes 33 in an upper wall of the chamber 3 to communicate with the lower chamber 12.

Figure 3:
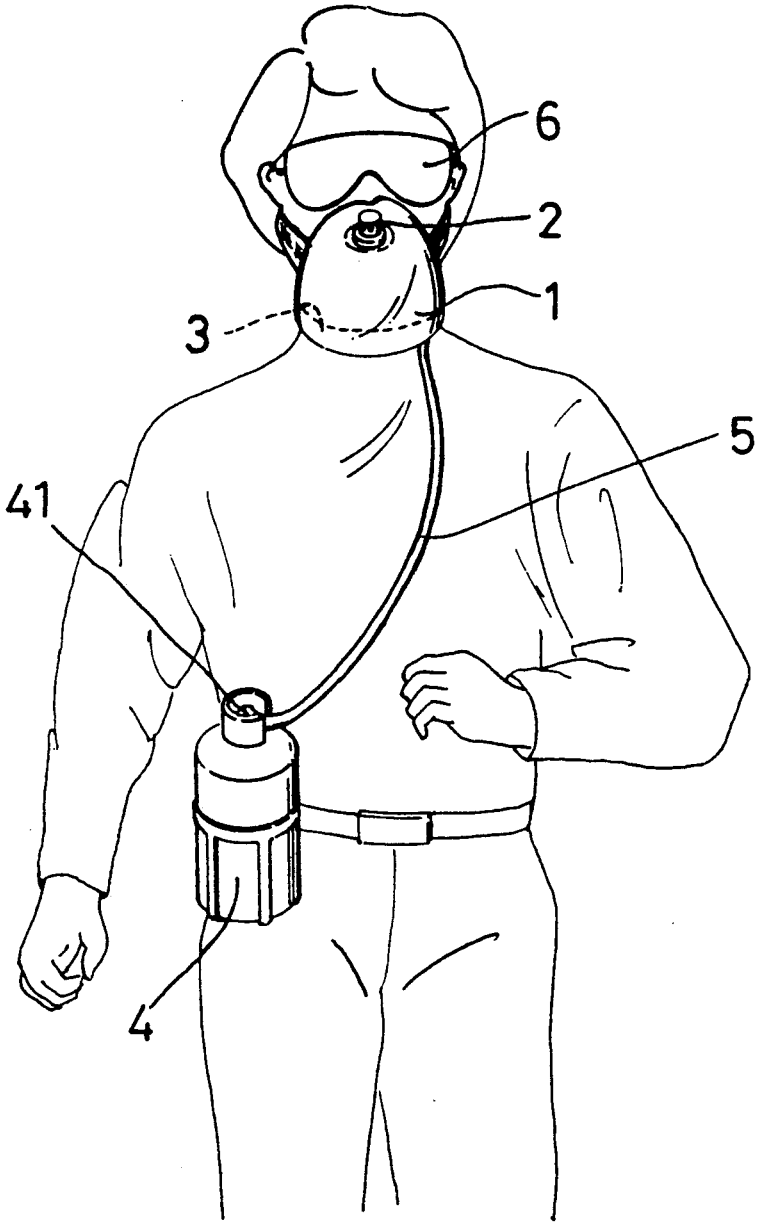

In using, referring to FIG. 3, a small oxygen tank 4 is provided to be connected with the inlet tap 32 of the oxygen chamber 3 with a connecting tube 5, and the volume of oxygen to be supplied is properly controlled by handling a control button 41 on the top of the oxygen tank. Then the oxygen entering the oxygen chamber 3 has its pressure lowered by the rather large dimensions of the chamber 3, and its flowing speed is also altered less and less by the separating plates 31 to flow out of the breathing holes 33 by sucking action of a mouth of a wearer. Exhaled air coming out of the nose flows into the upper chamber 11, passing through the exhaling valve 2 to push the sliding member 22 via the through hole 231 in the base 23, then to flow through the passageways 222, out of the outlet holes 211 of the upper cap 21 and into open air. The sliding member 22 drops down to block up the through hole 231 in the base 23 when exhaling action stops.

While the preferred embodiments of the invention have been described above, it will be recognized and understood that various modifications may be made therein and the appended claims are intended to cover all such modifications which may fall within the spirit and scope of the invention.

What is claimed is:

1. A smoke-proof mask comprising;

a body having an open side to be worn on a face surface to cover a nose, a mouth and a chin of a wearer so as to prevent smoke from flowing therein through a contacting line, an interior hollow divided into an upper chamber and a lower chamber, a hole in the upper portion of the upper chamber for fixing an exhaling valve therein;

an exhaling valve fixed in the hole in the body consisting of a cylindrical upper cap bored with small outlet holes, a sliding member deposited in the upper cap to slide up and down therein and having a plurality of vertical ridges to contact an inner wall of the upper cap to form the same number of passageways as that of the ridges between the upper cap and the sliding member, and a base with a central through hole passing through and being kept in the hole in the body from underneath to insert in the upper cap securely;

an oxygen chamber formed in the lower portion of the body under the lower chamber, divided by several separating vertical plates and several small holes provided in an upper separating wall to communicate with the lower chamber in the body and an inlet tap fixed to extend out of a bottom for a tube to fit therewith for connecting with a small oxygen tank; and said inlet tap receiving oxygen through the tube from a small oxygen tank, said oxygen flowing into the oxygen chamber and having its pressure lowered and being stored therein temporarily and then being inhaled up through the small holes of the oxygen chamber by inhaling action through a mouth of a wearer to go up into the lower chamber to be inhaled into a wearer's body, exhaled air out of the nose flowing into the upper chamber and then passing through the central hole in the base of the exhaling valve, said sliding member being pushed by the exhaled air to slide up to open the central hole of the base, letting the exhaled air pass through the passageways between the sliding member and the upper cap and finally through the small outlet holes of the upper cap out into open air, said sliding member falling down to block the central hole of the base to prevent open air for flowing into the upper chamber through the exhaling valve during inhaling action of the mouth of the wearer of the mask.

* * * * *